US005078643A

United States Patent [19]

Thill

[11] Patent Number: 5,078,643

[45] Date of Patent: Jan. 7, 1992

[54] NOISE EMITTING AND LIGHTED TWIRL TOY

[75] Inventor: Gerald D. Thill, Eden Prairie, Minn.

[73] Assignee: Spearhead Industries, Inc., Eden Prairie, Minn.

[21] Appl. No.: 585,660

[22] Filed: Sep. 20, 1990

[51] Int. Cl.[5] ..... A63H 5/00

[52] U.S. Cl. ..... 446/215; 446/219

[58] Field of Search ..... 446/3, 71, 73, 74, 77, 446/81, 176, 213, 214, 215, 219, 247, 251, 265, 266, 267, 397, 404

[56] References Cited

U.S. PATENT DOCUMENTS

| | | | |
|---|---|---|---|
| 684,998 | 10/1901 | Mauro | 446/215 |
| 1,800,778 | 4/1931 | Carson | 446/215 |
| 2,011,813 | 8/1935 | Heekin | 446/213 X |
| 3,009,285 | 11/1961 | Brown | 446/215 |
| 3,040,474 | 6/1962 | Sirks | 446/215 |
| 3,085,150 | 4/1963 | Bautsch | 446/81 X |
| 4,080,754 | 3/1978 | Nelson | 446/215 X |
| 4,193,222 | 3/1980 | Deschand | 446/215 |

*Primary Examiner*—Robert A. Hafer
*Assistant Examiner*—Sam Rimell
*Attorney, Agent, or Firm*—James R. Cwayna

[57] ABSTRACT

A toy designed for twirling or spinning by a person which not only emits a whistling sound but also includes a light emitting, replaceable unit with the light being emitted therefrom due to a chemical reaction initiated by the user. The toy is provided on a string for swinging of the same about his person with the whistling noise being emitted upon swinging of the same through the air. The unit may include reflective or attraction streamers attachable to the body of the unit and the light emitting portion of the unit is replaceable after exhaustion of the chemical reaction.

3 Claims, 2 Drawing Sheets

NOISE EMITTING AND LIGHTED TWIRL TOY

FIELD O THE INVENTION

This invention relates generally to toys to be swung in concentric circles by the user and more particularly to such a toy which emits a whistle noise and which includes a light emitting removeable, and replaceable source.

SHORT SUMMARY OF THE INVENTION

Applicant's unit includes a handle and attached string with the other end of the string being attached to a replaceable, removeable light emitting section which is flexible to permit breaking of an internal capsule to introduce two chemicals to one another with the interaction of chemicals providing a light producing reaction with the light emitting section being insertable into a whistle including a main body thereof. The main body of the toy includes a receiving passage arranged in side by side relation to a whistle producing cavity area into which the light source is placed. Adjacent this whistle producing cavity area is an extending ear to which a plurality of streamers or other attractive elements may be attached. The main body member of the toy is provided of a molded plastic and obviously the combined weight of this main body and the removeable and replaceable light emitting unit provide sufficient weight to be swung by the user in concentric circles.

BACKGROUND AND OBJECTS O THE INVENTION

Applicant is well aware of various auditory and luminous toys which are swingable by the user and these include devices such as those illustrated in US Patents granted to Deschand, No. 4,193,222; Nelson, No. 4,080,754; Waters, No. 143,044; Madden et al, No. 3,772,821; Arzola, No. 4,033,069; Wild, No. 3,034,499; and Greenspan, No. 4,299,394.

Of these Patents it would appear that the Patent to Deschand is the closest applicable art in that it does produce both an audible as well as a luminescent effect. It should be noted that in the Deschand Patent the auditory effect is obtained by a plurality of rubber bands disposed in parallel and spaced apart relation between slots of the main body thereof and this is a substantial differentiation from the structure provided herein by the applicant. The remaining Patents cited do not appear to utilize the combination of lights and noise other than the Patent to Nelson and this particular Patent includes a light bulb and an energizing source for the bulb.

None of the prior art illustrates a unit which affords the lumination effect as well as the whistling effect with substantial ease in removal and replacement of the illumination portion of the unit such as the same may be replaced after exhaustion of a chemical reaction.

In addition to the basic considerations stated above as to illumination and auditory effect, none of the cited references appear to afford means for attaching additional elements such as streamers or the like to the swingable body of the unit.

It is therefore an object of the applicant's invention to provide a swingable toy which incorporates both a noise emitting characteristic and a light emitting characteristic and affording means for attaching additional decorative elements thereto for an increased play effect.

It is a further object of the applicant's invention to provide a swingable, noise emitting and light emitting toy wherein the light emitting portion thereof is removeable for replacement upon exhaustion of the light source creating media embodied within the same.

It is still a further object of the applicant's invention to provide a swingable toy providing both auditory and illuminating effects which includes means for attaching additional attractive or decorative elements such as streamers or the like thereto.

These and other objects and advantages will more fully appear from a consideration of the accompanying description of the unit in conjunction with the accompanying drawings.

SHORT DESCRIPTION O THE DRAWINGS

DESCRIPTION OF THE PREFERRED EMBODIMENT

Figure 1:
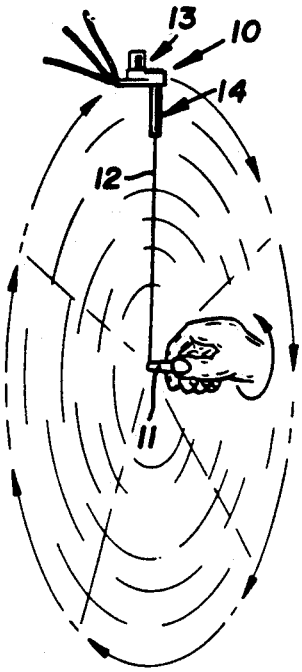
FIG. 1 is a perspective view of the toy embodying applicant's concepts as it would be used by a person to be swung by the person.
Figure 2:
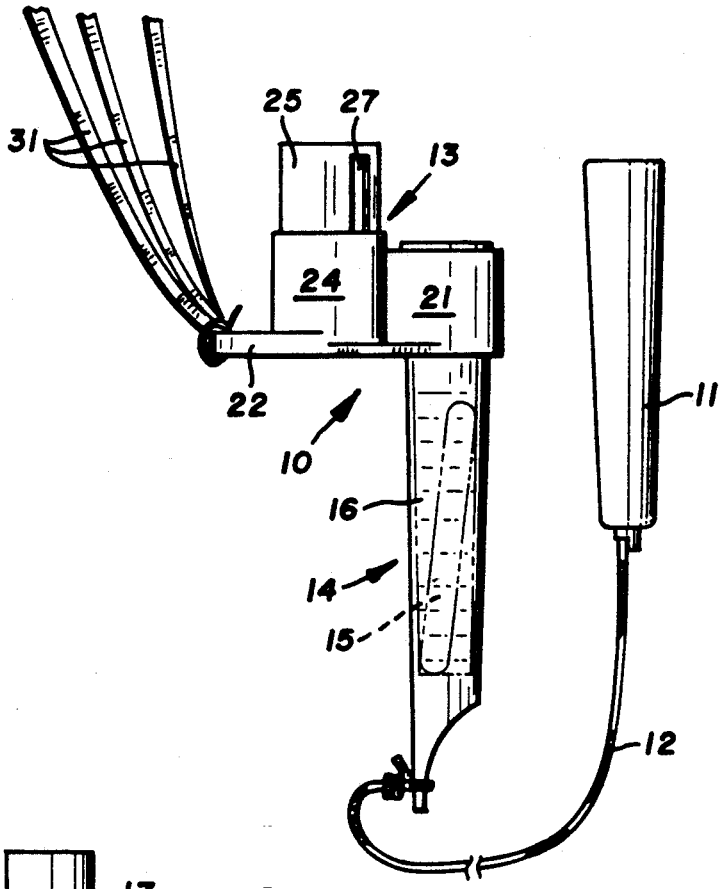
FIG. 2 is a side elevation of the unit.
Figure 3:
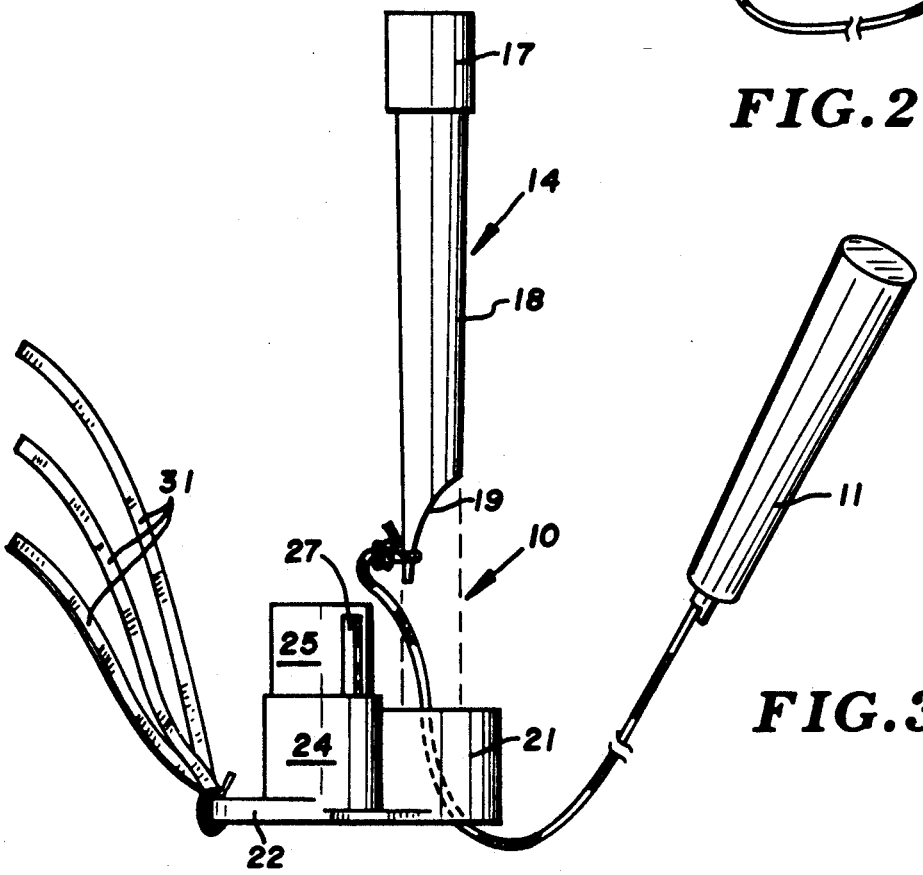
FIG. 3 is a view similar to FIG. 2 illustrating the removeability of the illuminating portion of the unit from the main body thereof.

In accordance with the accompanying drawings applicant's swingable noise emitting and lighted toy is generally designated 10 and is illustrated in usage in FIG. 1. As illustrated therein the unit 10 is designed to be held in a person's hand through the aid of a handle or grasping element 11 and the noise and light emitting portion is attached to the handle element 11 through a connective string 12. The string may be permanently attached to the handle 11 at one end thereof and is releasably tied to the whistle and light section at the other end thereof.

The basic toy section of the unit consists of two portions. These portions are a main body element 13 and a lightable or light generating capsule 14.

The light generating capsule 14 is generally cylindrical in shape and provides a closed end housing for positively retaining two chemicals or chemical compositions therein which composition is classified as a chemiluminescent material such as Cyalume (a Trademark of the American Cyanimid Co.). The elements are activated by the rupturing of an activator retaining pod 15 contained within capsule 14 which contains the other required ingredient of the chemical reactive portion of the unit. Obviously this light source is of a limited duration and must be replaced after expiration or exhaustion which is accomplished by replacing the entire housing 14. It should be obvious that the unit is useable with or without activation of the chemiluminescent substance.

As illustrated in FIGS. 2, 3, 10 and 11, the light source housing is generally cylindrical in shape having an enlarged cylindrical end 17 and an upwardly tapered chemical housing area 18 extending therefrom to a connective end 19 which, in the form shown includes an axially extending section having an aperture 19*a* therethrough to accommodate reception of the string portion therein.

Figure 4:
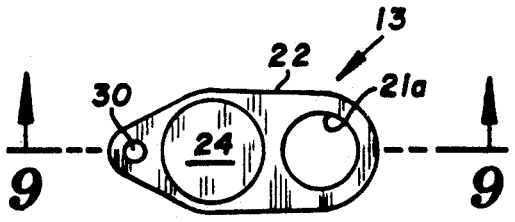
FIG. 4 is top plan view of the main body of the unit.
Figure 9:
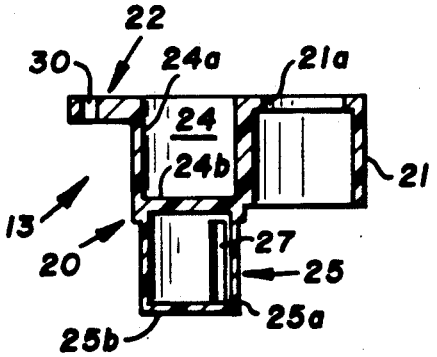
FIG. 9 is a cross section of the unit taken substantially along Line 9—9 of FIG. 4.
Figure 5:
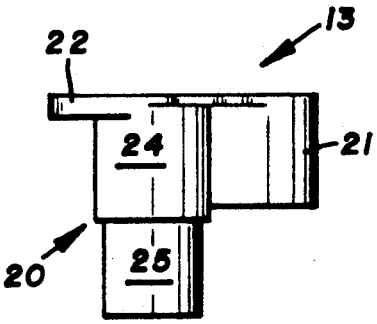
FIG. 5 is a side elevation taken from FIG. 4.
Figure 6:
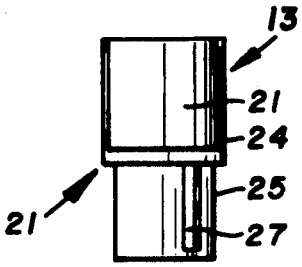
FIG. 6 is an end elevation taken from FIG. 5.
Figure 7:
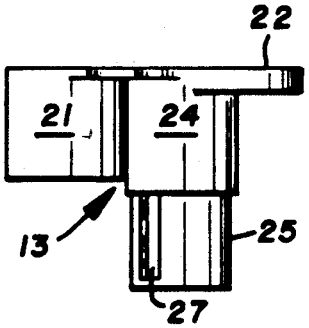
FIG. 7 is a side elevation opposite that of FIG. 5.
Figure 8:
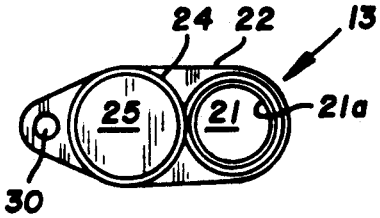
FIG. 8 is a bottom plan view.
Figure 10:
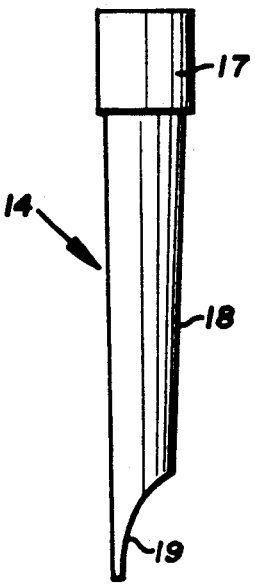
FIG. 10 is a side elevation of the light encapsulating capsule section of the unit; and, FIG. 11 is a side elevation taken from FIG. 10.
Figure 11:
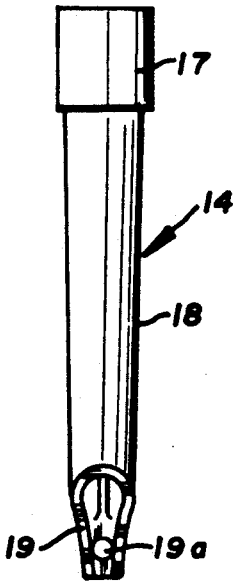

Sizing of the cylindrical end 17 is coordinated with the size of the main body portion 13 of the unit 10 to accommodate removeable placement of the same and separable connection of the two elements 13, 14. The main body housing 13 which includes the noise emitting portion is illustrated in detail in FIGS. 4–9. As illustrated therein a pair of side-by-side circular, longitudinally extending sections are provided designated respectively 20, 21 which extend from a common plate member 22. The first of such extending members 21 is arranged to receive the aforementioned cylindrical portion 17 of the light containing section 14 therein and a passage 21*a* is provided at the end of such cylindrical housing to afford passage of the longitudinal extending section 18 of the light housing 14 therethrough. As particularly illustrated in FIG. 9 the other section 20 of the unit consists of a pair of arcuate housings arranged in end to end fashion. The first such housing is designated 24 and includes a tubular extending portion of side walls 24*a* and a bottom 24*b* extending downwardly from the aforementioned plate member or surface 22. The second such section is designated 25 and includes a closed end housing having arcuate sides 25*a* and a closed end 25*b*, the other end of which section 25 being closed by the bottom 24*b* of the first mentioned section 24. As particularly illustrated in FIGS. 6, 7 and 9 a longitudinally extending, generally rectangular passage 26 is formed into the housing side 25*a* for the admittance of air into the confined area of such section. Air movement past the opening 27 and into and out of such passage 27 produces the auditory noise emitted when the toy unit 10 is swung about one's person. As particularly illustrated in FIGS. 4 and 8, plate member 22 extends outwardly from the boundary of the two aligned sections 20–21 to provide an attachment ear having a second securing aperture 30 formed therein. It is this aperture 30 to which a plurality of streamers 31 or the like may be attached to add to the play effect of the unit.

The operation of the unit should be obvious from the drawing of FIG. 1 and probably is obvious to anyone without any description of the use of the same. The only description that is required for utilization is thought to be that of the rupturing of the internal pod within the light housing and emitting section 14 to activate the light source. Obviously after the light has been exhausted, replacement of the entire light section 14 is necessary.

The aspects of the applicant's device which would appear to be unique and structurally different from the prior art is the particular main body portion 13 of the unit and its cooperation with the removeability and replaceability of the luminescent capsule housing 14. At least, to the applicant's knowledge, the prior art does illustrate one similarly lighted audible and luminous toy as described herein but the attachment arrangement situation in the device as described in the art is substantially different and more complicated than the simple interfit of the applicant's device. As this is a child's toy the simplicity of operation is thought to be essential to afford its use by children.

What is claimed is:

1. A noise emitting and illuminatable toy for whilring including:

a. handle means;

b. a flexible connective means having one end thereof attached to said handle means;

c. a chemiluminescent light housing including a longitudinally extending, hollow body member for retaining chemiluminescent elements therein;

d. said light housing body having an enlarged circular end to provide a locating shoulder therealong and having an attachment aperture on the eh other end thereof for attachment to said flexible connective means;

e. a body member including a plate having a passage therethrough for abutment with said shoulder of said light housing body thereagainst;

f. said body member including an air vibratory section consisting of a longitudinally extending, closed end cylinder having an air passage formed in the longitudinally extending side thereof.

2. A noise emitting and illuminable toy for whilring as st froth in claim 1 and said plate having a decorative element receiving passage formed therein for attachment of articles thereto.

3. A noise emitting and illuminable toy for whirling as set forth in claim 1 and said air vibratory section being spaced from said plate with a longitudinally extending hollow, cylindrical housing providing an opening through said plate.

* * * * *